US008585355B2

(12) United States Patent
Henderson et al.

(10) Patent No.: US 8,585,355 B2
(45) Date of Patent: Nov. 19, 2013

(54) SIMPLIFIED VARIABLE GEOMETRY TURBOCHARGER WITH SLIDING GATE AND MULTIPLE VOLUTES

(75) Inventors: Kurtis E. Henderson, Candler, NC (US); Rajmohan Chandramohanan, Fletcher, NC (US)

(73) Assignee: BorgWarner Inc, Auburn Hills, MI (US)

( * ) Notice: Subject to any disclaimer, the term of this patent is extended or adjusted under 35 U.S.C. 154(b) by 672 days.

(21) Appl. No.: 12/758,894

(22) Filed: Apr. 13, 2010

(65) Prior Publication Data

US 2010/0266390 A1 Oct. 21, 2010

Related U.S. Application Data

(60) Provisional application No. 61/170,807, filed on Apr. 20, 2009.

(51) Int. Cl.
*F04D 29/46* (2006.01)

(52) U.S. Cl.
USPC ..... 415/151; 415/158

(58) Field of Classification Search
USPC ..... 415/148, 151, 157, 158, 184, 185, 205, 415/208.2, 912
See application file for complete search history.

(56) References Cited

U.S. PATENT DOCUMENTS 1,857,965 A * 5/1932 Lidiak ..... 415/184
2,577,179 A * 12/1951 Buchi ..... 415/115
3,005,618 A * 10/1961 Walder ..... 415/184
3,930,747 A * 1/1976 Woollenweber ..... 415/205
4,565,068 A * 1/1986 Schneider ..... 60/602
6,073,447 A * 6/2000 Kawakami et al. ..... 60/602
6,598,395 B2 * 7/2003 Daudel et al. ..... 60/602
7,269,950 B2 * 9/2007 Pedersen et al. ..... 60/602
7,694,518 B2 * 4/2010 Whiting et al. ..... 60/602

FOREIGN PATENT DOCUMENTS

DE 10112552 * 9/2001
EP 0212834 * 3/1987

OTHER PUBLICATIONS

Adachi et al., Turbocharger, Sep. 27, 2001, Abstract of DE10112552.*

* cited by examiner

*Primary Examiner* — Edward Look
*Assistant Examiner* — Liam McDowell
(74) *Attorney, Agent, or Firm* — Miller Canfield

(57) ABSTRACT

A simplified, low cost, turbine flow controlling device, using a sliding gate, with an actuator to control exhaust flow to multiple volutes, which volutes have perforated transverse divider walls. By moving the sliding gate (80) from a closed position (88) through a displacement of "a" to the next position $b_1$; and then from position $b_1$ through a displacement of "b" to the next position $c_1$, each a discreet movement, by a simple actuator, an increasing number of volutes are opened for flow from the exhaust manifold, via the volutes with perforated transverse divider walls, to the turbine wheel, without the attenuation of pulse energy usually seen in VTGs, at a cost lower than that of a VTG.

9 Claims, 16 Drawing Sheets

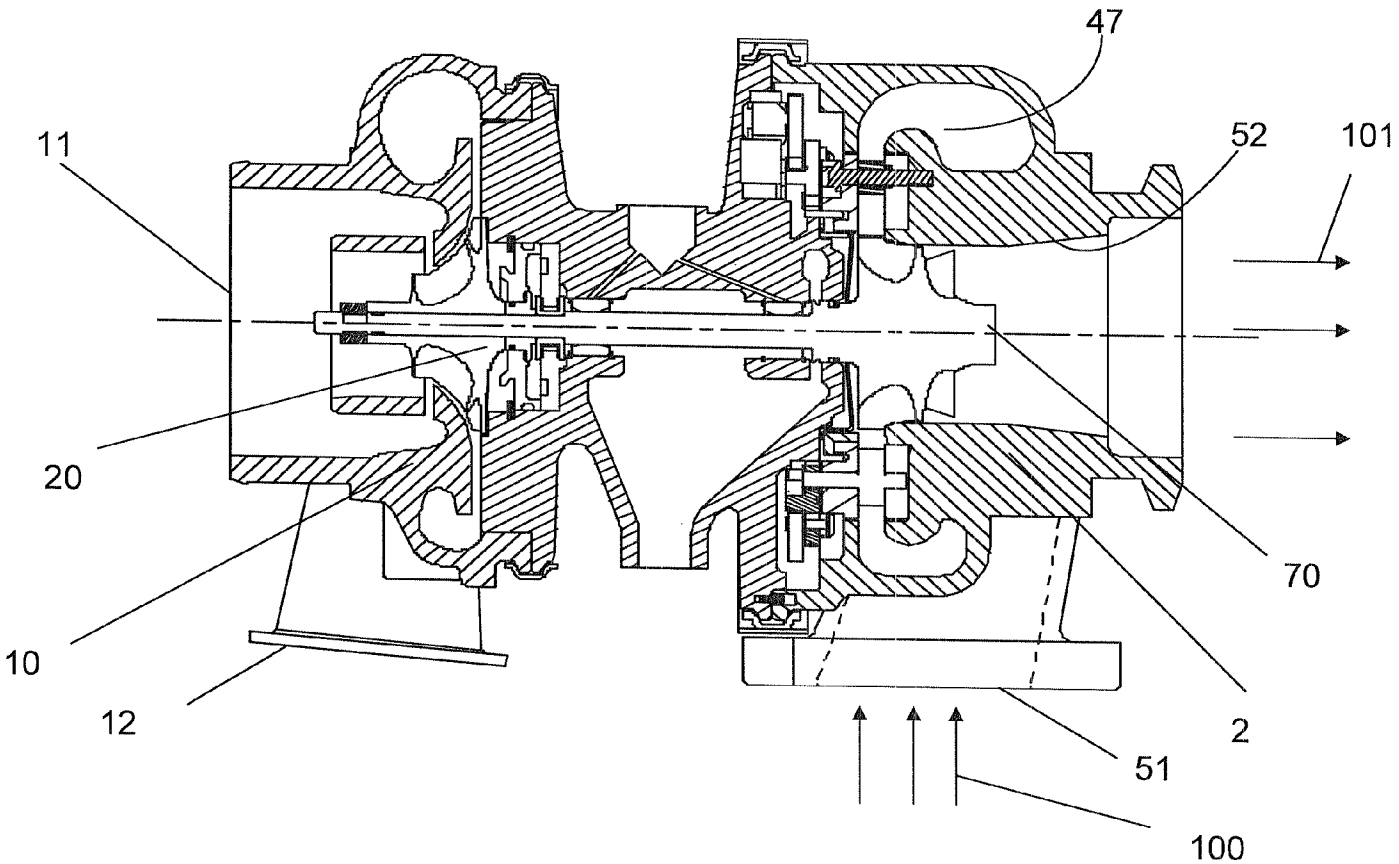
Fig. 1Prior Art

SIMPLIFIED VARIABLE GEOMETRY TURBOCHARGER WITH SLIDING GATE AND MULTIPLE VOLUTES

FIELD OF THE INVENTION

This invention is directed to the design of a low cost turbine flow control device capable of maintaining exhaust gas velocity and pulse energy. The low cost turbocharger is matched to low flow regimes to provide optimized turbo (and thus engine) transient response for low flow while being capable of delivering the high flows demanded by the engine in other than low flow conditions, in the same, cost-effective turbocharger.

BACKGROUND OF THE INVENTION

Turbochargers are a type of forced induction system. They deliver air, at greater density than would be possible in the normally aspirated configuration, to the engine intake, allowing more fuel to be combusted, thus boosting the engine's horsepower without significantly increasing engine weight. This can enable the use of a smaller turbocharged engine, replacing a normally aspirated engine of a larger physical size, thus reducing the mass and aerodynamic frontal area of the vehicle.

Turbochargers (FIG. 1) use the exhaust flow (100), which enters the turbine housing at the turbine inlet (51) of the turbine housing (2), from the engine exhaust manifold and flows through the turbine volute (47) to drive a turbine wheel (70), which is located in a turbine housing (50). The turbine wheel is solidly affixed to a shaft, the other end of which contains a compressor wheel which is mounted to the shaft and held in position by the clamp load from a compressor nut. The primary function of the turbine wheel is providing rotational power to drive the compressor. Once the exhaust gas has passed through the turbine wheel (70) and the turbine wheel has extracted energy from the exhaust gas, the spent exhaust gas (101) exits the turbine housing (2) through the exducer (52) and is ducted to the vehicle downpipe and usually to the after-treatment devices such as catalytic converters, particulate and $NO_x$ traps.

The power developed by the turbine stage is a function of the expansion ratio across the turbine stage. That is the expansion ratio from the turbine inlet (51) to the turbine exducer (52). The range of the turbine power is a function of, among other parameters, the flow through the turbine stage.

The compressor stage consists of a wheel and its housing. Filtered air is drawn axially into the inlet (11) of the compressor cover (10) by the rotation of the compressor wheel (20). The power generated by the turbine stage to the shaft and wheel drives the compressor wheel (20) to produce a combination of static pressure with some residual kinetic energy and heat. The pressurized gas exits the compressor cover (10) through the compressor discharge (12) and is delivered, usually via an intercooler, to the engine intake.

The design of the turbine stage is a compromise among the power required to drive the compressor, at different flow regimes in the engine operating envelope; the aerodynamic design of the stage; the inertia of the rotating assembly, of which the turbine is a large part since the turbine wheel is manufactured typically in Inconel which has a density 3 times that of the aluminum of the compressor wheel; the turbocharger operating cycle which affects the structural and material aspects of the design; and the near field both upstream and downstream of the turbine wheel with respect to blade excitation.

Part of the physical design of the turbine housing is a volute, the function of which is to control the inlet conditions to the turbine wheel such that the inlet flow conditions provide the most efficient transfer of power from the energy in the exhaust gas to the power developed by the turbine wheel, combined with the best transient response characteristics. Theoretically the incoming exhaust flow from the engine is delivered in a uniform manner from the volute to a vortex centered on the turbine wheel axis. To do this, the cross sectional area of the volute is at a maximum perpendicular to the direction of flow gradually and continuously decreasing until it becomes zero. The inner boundary of the volute can be a perfect circle, defined as the base circle; or, in certain cases, such as a twin volute, it can describe a spiral, of minimum diameter not less than 106% of the turbine wheel diameter. The volute is defined by the decreasing radius of the outer boundary of the volute and by the inner boundary as described above, in one plane defined in the "X-Y" axis as depicted in FIG. 4, and the cross sectional areas, at each station, as depicted in FIG. 8, in the plane passing through the "Z" axis, The "Z" axis is perpendicular to the plane defined by the "X-Y" axis and is also along the axis of the turbine wheel.

The design development of the volute initiates at slice "A", which is defined as the datum for the volute. The datum is defined as the slice at an angle of "P" degrees above the "X"-axis of the turbine housing containing the "X"-axis, "Y"-axis and "Z"-axis details of the volute shape.

The size and shape of the volute is defined in the following manner: The widely used term A/R represents the ratio of the partial area at slice "A" divided by the distance from the centroid (161) of the shaded flow area (160) to the turbo centerline. In FIGS. 8A and B, the centroids (161) determine the distance $R_A$ and $R_B$ to the turbo centerline. For different members of a family of turbine housings, the general shape remains the same, but the area at slice "A" is different as is the distance $R_A$. The A/R ratio is generally used as the "name" for a specific turbine housing to differentiate that turbine housing from others in the same family (with different AIR ratios). In FIG. 8A, the volute has a reasonably circular shape. In FIG. 8B the volute shape is that of a divided turbine housing which forces the shape to be reasonably triangular. Although the areas at slice "A" for both volutes are the same, the shapes are different and the radii to the centroids are different (due to the volute shape), so the A/Rs will be different. Slice "A" is offset by angle "P" from the "X"-axis. The turbine housing is then geometrically split into equal radial slices (often 30°, thus at [30x+P]°), and the areas ($A_{A-M}$) and the radii ($R_{A-M}$) along with other geometric definitions such as corner radii are defined. From this definition, splines of points along the volute walls are generated thus defining the full shape of the volute. The wall thickness is added to the internal volute shape and through this method a turbine housing is defined.

The area of a slice of the volute is defined as the area bounded by the inner surfaces of the volute wall, at that slice and the base circle (71).

The theoretically optimized volute shape for a given area is that of a circular cross-section since it has the minimum surface area which minimizes the fluid frictional losses. The volute, however, does not act on its own but is part of a system; so the requirements of flow in the planes from slice "A", shown in FIG. 4 to the plane at slice "M", and from "M" to the tongue, influence the performance of the turbine stage. These requirements often result in compromises such as architectural requirements outside of the turbine housing, method of location and mounting of the turbine housing to the bearing housing, and the transition from slice "A" to the turbine foot (51) result in turbine housing volutes of rectangular or triangular section, as well as in circular, or combinations of all shapes. The rectangular shape of the volute (47) in FIG. 1, showing a section "D-K" is a result of the requirement not only to fit VTG vanes into the space such that the flow is optimized through the vanes and that the vanes can be moved and controlled by devices external to the turbine housing, but also to minimize the outline of the turbine housing so the turbocharger fits on an engine.

The turbine housing foot is usually of a standard design as it mates to exhaust manifolds of many engines. The foot can be located at any angle to, or position relative to, the "volute". The transition from the foot gas passages to the volute is executed in a manner which provides the best aerodynamic and mechanical compromise.

The roughly triangular shape of the volute in FIGS. 2A and 2B, taken at the same sections as those above, is the more typical volute geometry for fixed and wastegated turbine housings. The addition of the divider wall (21) is to reduce aerodynamic "cross-talk" between the volutes in an effort to maintain pulse flow, from a divided manifold, to harvest the pulse energy in the work extracted by the turbine wheel. The pressure pulses in the exhaust manifold are a function of the firing order of the engine.

Turbine housings are typically designed in families (typically up to 5 in a family) which use turbine wheels of the same diameter, or a group of wheels with close to the same diameter. They may use the same turbine foot size. For example, a family of turbine housings for a 63 mm turbine wheel may cover a range of A/Rs from 1.8 to 2.2. FIG. 5 depicts the area schedule for three volutes of a family. The largest volute is a 1.2 A/R volute, shown by the dotted line (45). The smallest volute is a 0.8 A/R volute; shown by the dashed line (46) and the mean volute, in the middle of the family, is shown by the solid line. The X-axis depicts the angle of the slice, from 30° (section "A") to 360° (the tongue); the Y-axis depicts the area of the section at the respective angle.

Some turbine wheels are specifically designed to harness this pulse energy and convert it to rotational velocity. Thus the conversion of pressure and velocity from the exhaust gas for a pulse flow turbine wheel in a divided turbine housing is greater than the conversion of pressure and velocity from a steady state exhaust flow to the turbine wheel velocity. This pulse energy is more predominant in commercial Diesel engines, which operate at around 2200 RPM, with peak torque at 1200 to 1400 RPM, than in gasoline engines which operate at much higher rotational speed, often up to 6000 RPM, with peak torque at 4000 RPM so the pulse is not as well defined.

The basic turbocharger configuration is that of a fixed turbine housing. In this configuration the shape and volume of the turbine housing volute (53) is determined at the design stage and cast in place.

Some fixed turbine housings use a nozzle ring (33), as seen in FIG. 9A to assist in the turning and acceleration of the exhaust gas into the turbine wheel. These nozzle rings are often used in multi-cylinder engine with split manifolds. The design depicted in FIG. 9A is that for a V-12 military tank engine which feeds double flow turbine housings. This configuration has been in production since the early 1950s. The configuration of the interim volute wall (58) where the downstream end of the wall (or tongue) (92) is opposite the termination, or tongue (93) of the outer volute wall (53) is known as a double flow turbine housing.

The next level of sophistication is that of a wastegated turbine housing. In this configuration the volute is cast in place, as in the fixed configuration above. In FIG. 2, the wastegated turbine housing features a port (54) which fluidly connects the turbine housing volute (53) to the turbine housing exducer (52). Since the port on the volute side is upstream of the turbine wheel (70), and the other side of the port, on the exducer side, is downstream of the turbine wheel, flow through the duct connecting these ports bypasses the turbine wheel (70), thus not contributing to the power delivered to the turbine wheel.

The wastegate in its most simple form is a valve (55), which can be a poppet valve. It can be a swing type valve similar to the valve in FIG. 2B. Typically these valves are operated by a "dumb" actuator which senses boost pressure or vacuum to activate a diaphragm, connected to the valve, and operates without specific communication to the engine ECU. The function of the wastegate valve, in this manner, is to cut the top off the full load boost curve, thus limiting the boost level to the engine. The wastegate configuration has no effect on the characteristics of the boost curve until the valve opens. More sophisticated wastegate valves may sense barometric pressure or have electronic over-ride or control, but they all have no effect on the boost curve until they actuate to open or close the valve.

FIG. 6A depicts the boost curve (65) for a fixed turbine housing. FIG. 6B depicts the boost curve (67) for a wastegated turbine housing of the same NR as that for FIG. 6A, or a wastegated turbine housing in which the wastegate valve did not open. In FIG. 6B it can be seen that the shape of the boost curve (67) is exactly the same as the boost curve (65) in FIG. 6A to the point (66) at which the valve opens. After this point, the boost curve is flat. While a wastegate can be used to limit boost levels, its turbine power control characteristics are rudimentary and coarse.

A positive byproduct of wastegated turbine housings is the opportunity to reduce the A/R of the turbine housings. Since the upper limit of the boost is controlled by the wastegate, a reduction in A/R can provide better transient response characteristics. If the wastegated turbocharger has a "dumb" actuator, which operates on a pressure or vacuum signal only, and is operated at altitude, then the critical pressure ratio at which the valve opens is detrimentally affected. Since the diaphragm in the actuator senses boost pressure on one side, and barometric pressure on the other, the tendency is for the actuator to open later (since the barometric pressure at altitude is lower than that at sea level) resulting in over-boost of the engine.

Engine boost requirements are the predominant drivers of compressor stage selection. The selection and design of the compressor is a compromise between the boost pressure requirement of the engine; the mass flow required by the engine; the efficiency required by the application; the map width required by the engine and application; the altitude and duty cycle to which the engine is to be subjected; the cylinder pressure limits of the engine; etc.

The reason this is important to turbocharger operation is that the addition of a wastegate to the turbine stage allows matching to the low speed range with a smaller turbine wheel and housing. Thus the addition of a wastegate brings with it the option for a reduction in inertia. Since a reduction in inertia of the rotating assembly typically results in a reduction of particulate matter (PM), wastegates have become common in on-highway vehicles. The problem is that most wastegates are somewhat binary in their operation, which does not fit well with the linear relationship between engine output and engine speed.

U.S. Pat. No. 4,389,845 to Koike teaches the use of an actuator for selectively controlling the flow of exhaust gases from the inlet to a second scroll while maintaining flow of such gases to a first scroll. See FIG. 9B in which the actuator (22) controls a valve (16) which controls the flow into the first or second and first volutes formed by a solid divider wall (11). This is basically the typical double flow turbine housing of FIG. 9A but with a diaphragm operated, sliding gate valve.

The next level of sophistication in boost control of turbochargers is the VTG (the general term for variable turbine geometry). Some of these turbochargers have rotating vanes; some have sliding sections or rings. Some titles for these devices are: variable turbine geometry (VTG), variable geometry turbine (VGT), variable nozzle turbine (VNT), or, simply, variable geometry (VG).

VTG turbochargers utilize adjustable guide vanes FIGS. 3A and 3B, rotatably connected to a pair of vane rings and/or the nozzle wall. These vanes are adjusted to control the exhaust gas backpressure and the turbocharger speed by modulating the exhaust gas flow to the turbine wheel. In FIG. 3A the vanes (31) are in the minimum open position. In FIG. 3B the vanes are in the maximum open position. The vanes can be rotatably driven by fingers engaged in a unison ring, which can be located above the upper vane ring. For the sake of clarity, these details have been omitted from the drawings. VTG turbochargers have a large number of very expensive alloy components which must be assembled and positioned in the turbine housing so that the guide vanes remain properly positioned with respect to the exhaust supply flow channel and the turbine wheel over the range of thermal operating conditions to which they are exposed. The temperature and corrosive conditions force the use of exotic alloys in all internal components. These are very expensive to procure, machine, and weld (where required). Since the VTG design can change turbocharger speed very quickly, extensive software and controls are a necessity to prevent unwanted speed excursions. This translates to expensive actuators. While VTGs of various types and configurations have been adopted widely to control both turbocharger boost levels and turbine backpressure levels, the cost of the hardware and the cost of implementation are high.

In order to keep flow attached to the volute walls and to keep the shape of the volute appropriate to the function of the volute, an A/R schedule is plotted, as in FIG. 5, to ensure that there exist no inappropriate changes in section. In FIG. 5, the "X" axis is the angle for each section. The angles could be substituted by the defining letters "A" though "M" as used in FIG. 4. The "Y" axis depicts the radius of the section. The dotted line (45) is the area schedule for the largest A/R of the family. The dashed line (46) is the area schedule for the smallest A/R of the family.

If one considers a wastegated turbo as a baseline for cost, then the cost of a typical TVG, in the same production volume, is from 270% to 300% the cost of the same size fixed turbocharger. This disparity is due to a number of pertinent factors from the number of components, the materials of the components, the accuracy required in the manufacture and machining of the components, to the speed, accuracy, and repeatability of the actuator. The chart in FIG. 7 shows the comparative cost for the range of turbochargers from fixed to VTGs. Column "A" represents the benchmark cost of a fixed turbocharger for a given application. Column "B" represents the cost of a wastegated turbocharger for the same application, and column "C" represents the cost of a VTG for the same application.

Thus it can be seen that for both technical reasons and cost drivers that there needs to be a relatively low cost turbine flow control device which fits between wastegates and VTGs in terms of cost. The target cost price for such a device needs to be in the range of 145% to 165% that of a simple, fixed turbocharger.

SUMMARY OF THE INVENTION

The present invention accomplishes the above mentioned objectives and provides a simplified, low cost, turbine flow controlling device by designing a turbocharger to use a sliding gate, with a discreetly positioning actuator to control the gate to control exhaust flow to multiple volutes, which volutes have perforated transverse divider walls. In another embodiment of the invention the flow to the turbine wheel is controlled by a pivoting transverse divider wall.

BRIEF DESCRIPTION OF THE DRAWINGS

The present invention is illustrated by way of example and not limitation in the accompanying drawings in which like reference numbers indicate similar parts, and in which:

FIG. 1 depicts the section for a typical VTG turbocharger;

DETAILED DESCRIPTION OF THE INVENTION

Since the use of vanes in variable geometry turbochargers attenuates the pulse flow component available in the exhaust flow, the inventors sought to be able to modulate the exhaust flow to the turbine wheel, while maintaining the pulse energy in the exhaust flow. The use of multiple vanes, "wetted" by the exhaust flow, and the mechanisms to control and move said vanes, adds tremendous cost, in the range of over double the cost of the basic turbocharger.

In accordance with the present invention, by employing multiple smaller volume volutes to maintain exhaust gas velocity and pulse energy, the inventors used a combination of low volume volutes and a discretely movable blade to allow flow into successive volutes to provide both a cost and technically effective alternative to control the flow of exhaust gas to the turbine. In the case of the volute divided by two divider walls into three volute portions, blockage of two volutes leaving one volute open will cause the turbocharger to act like a smaller displacement turbocharger, with more rapid transient response at low exhaust gas flows. Opening of all three volute portions will accommodate high gas flow rates. Thus, the turbocharger provides advantages of a variable geometry turbocharger, but at reduced cost. In addition to the above gains, the inventors sought to provide a turbocharger matched to low flow regimes to provide optimized turbo (and thus engine) transient response for low flow while being capable of delivering the high flows demanded by the engine in other than low flow conditions, in the same, cost-effective turbocharger.

Figures 2A, 2B:
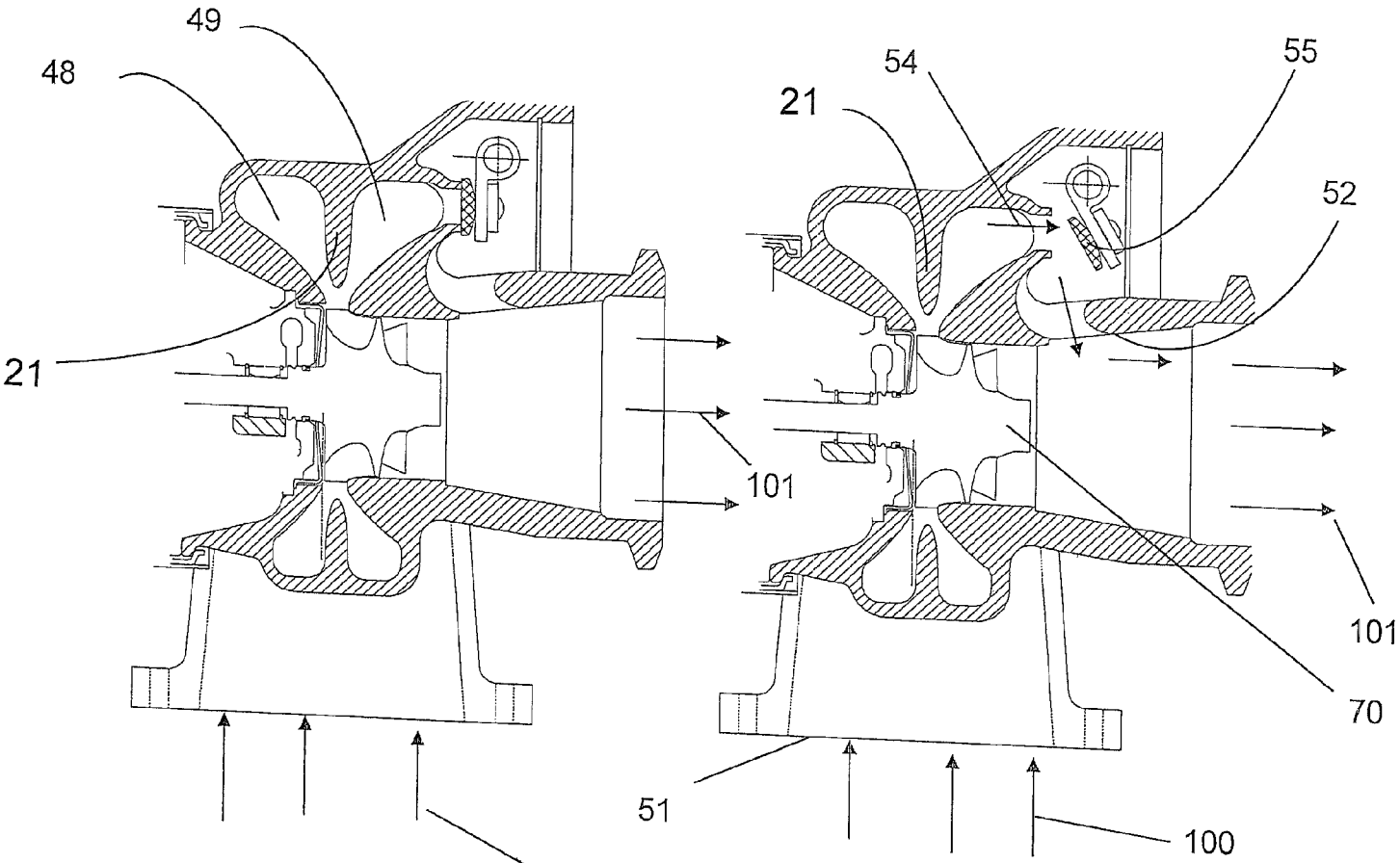
Fig. 2B Prior Art
Fig. 2A Prior Art
FIGS. 2A and 2B depict a pair of sections of a typical wastegated turbocharger.
Figure 3B:
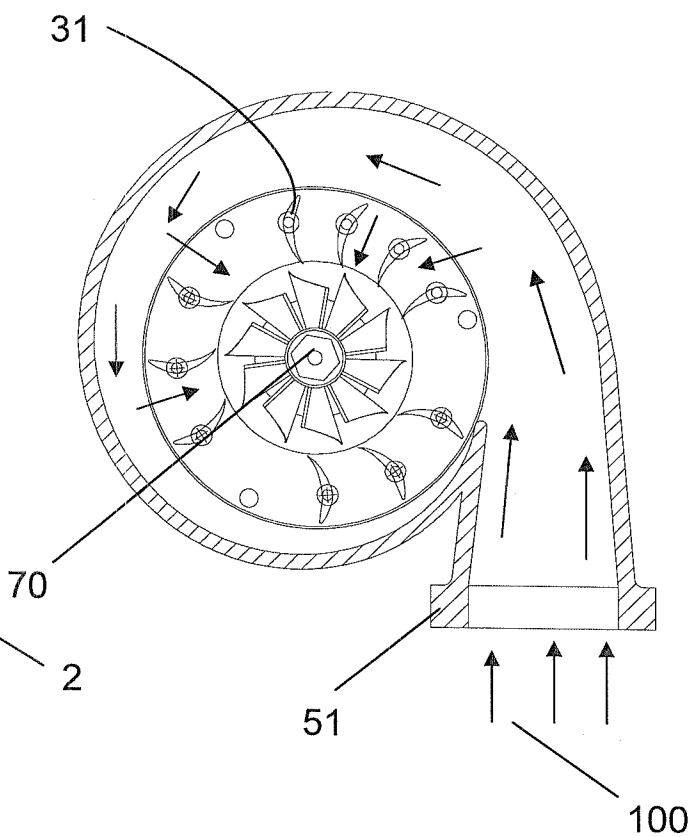
Fig. 3B Prior Art
FIGS. 3A and 3B depict a pair of sections of a typical VTG turbocharger.
Figure 3A:
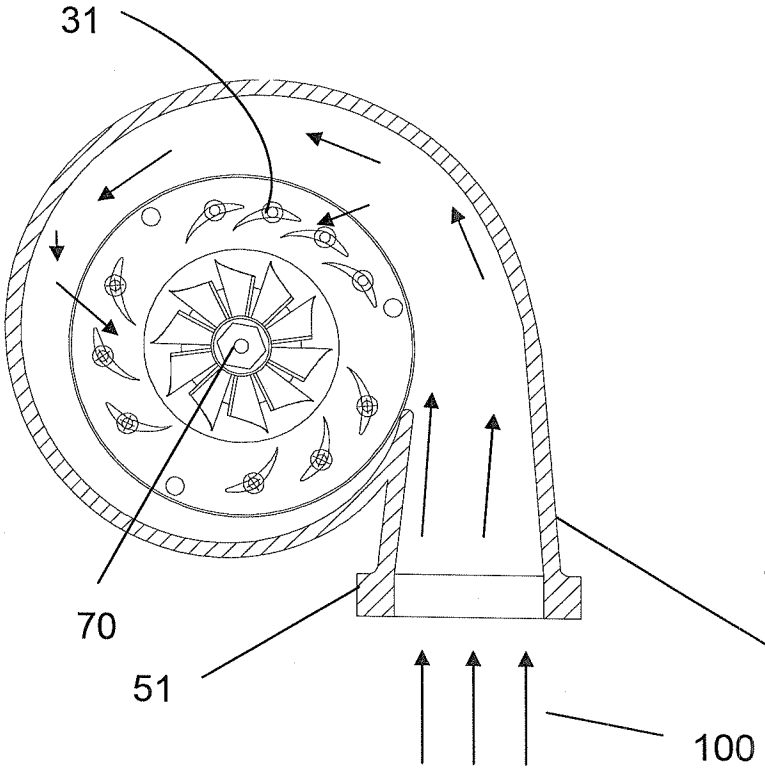
Fig. 3A Prior Art
Figure 4:
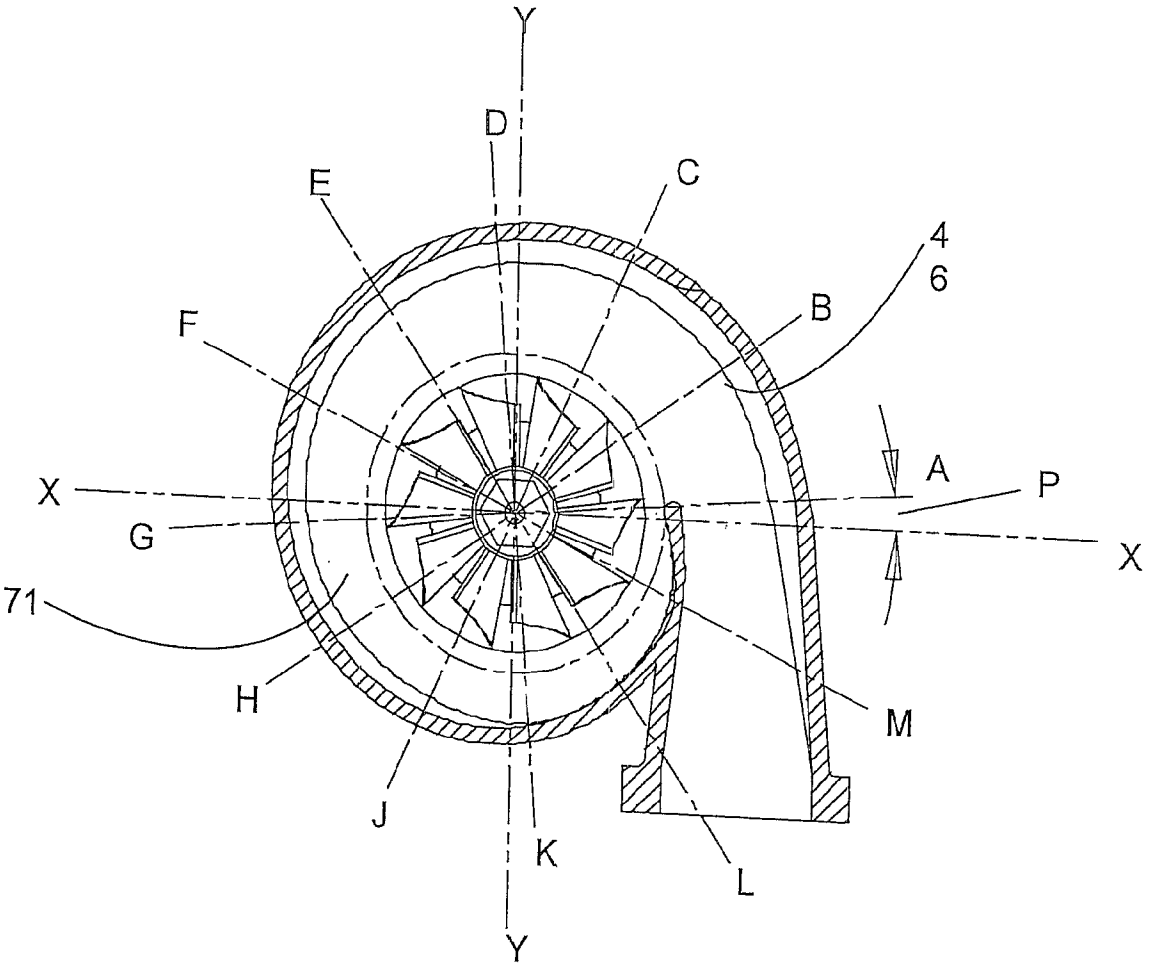
Fig. 4 Prior Art
FIG. 4 depicts a section of a typical fixed turbine housing showing construction radial lines.
Figure 5:
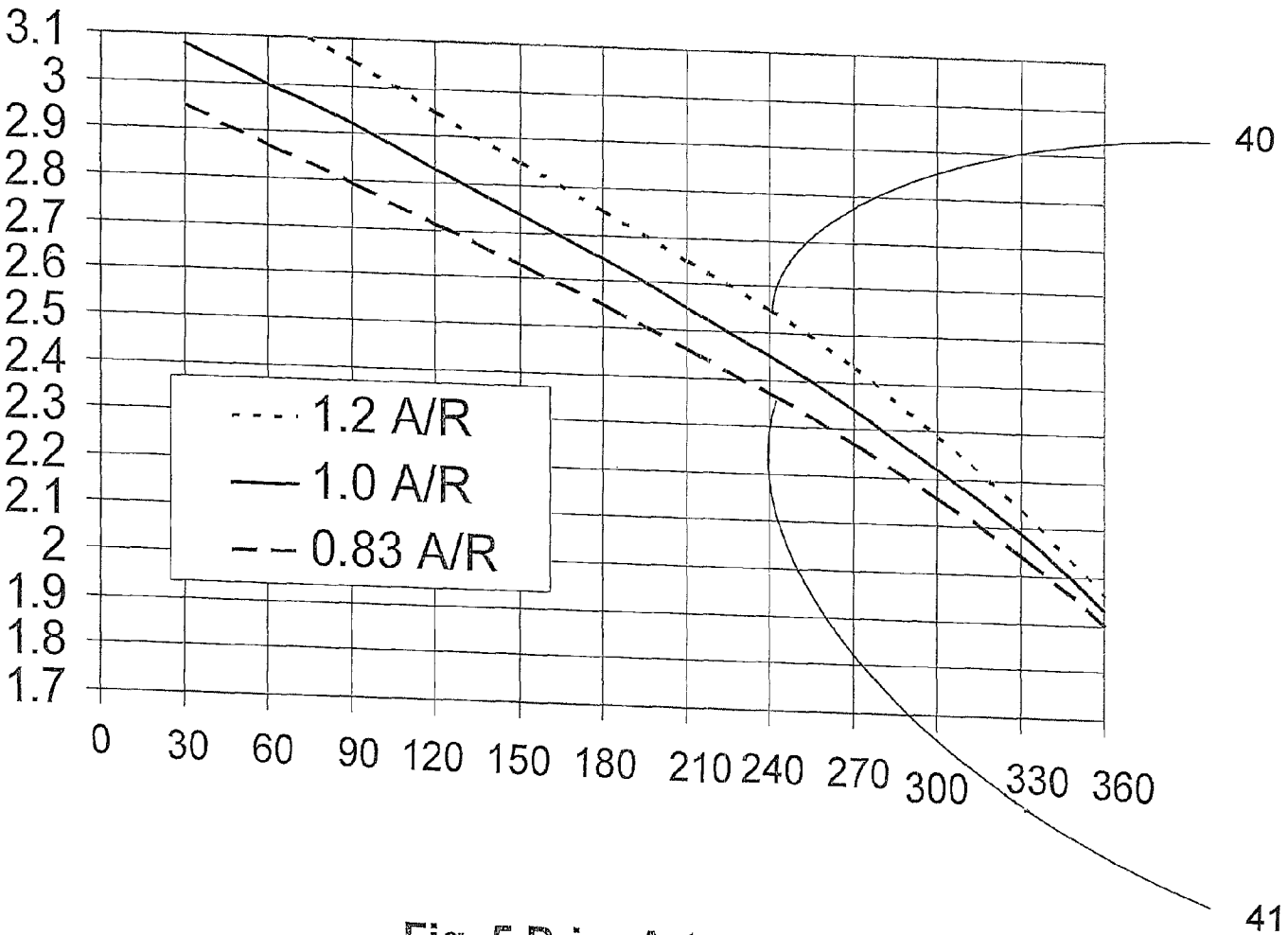
Fig. 5 Prior Art
FIG. 5 is a chart of cross-sectional area development.
Figure 6B:
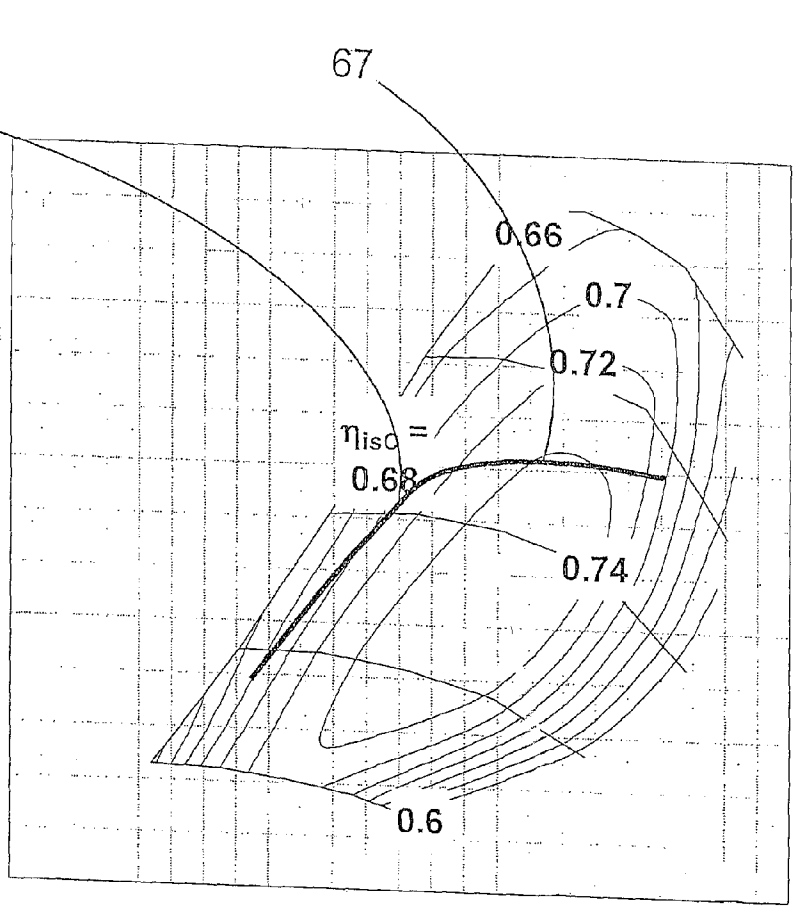
Fig. 6B Prior Art
FIG. 6 depicts the compressor maps for a typical fixed, and a wastegated turbocharger.
Figure 6A:
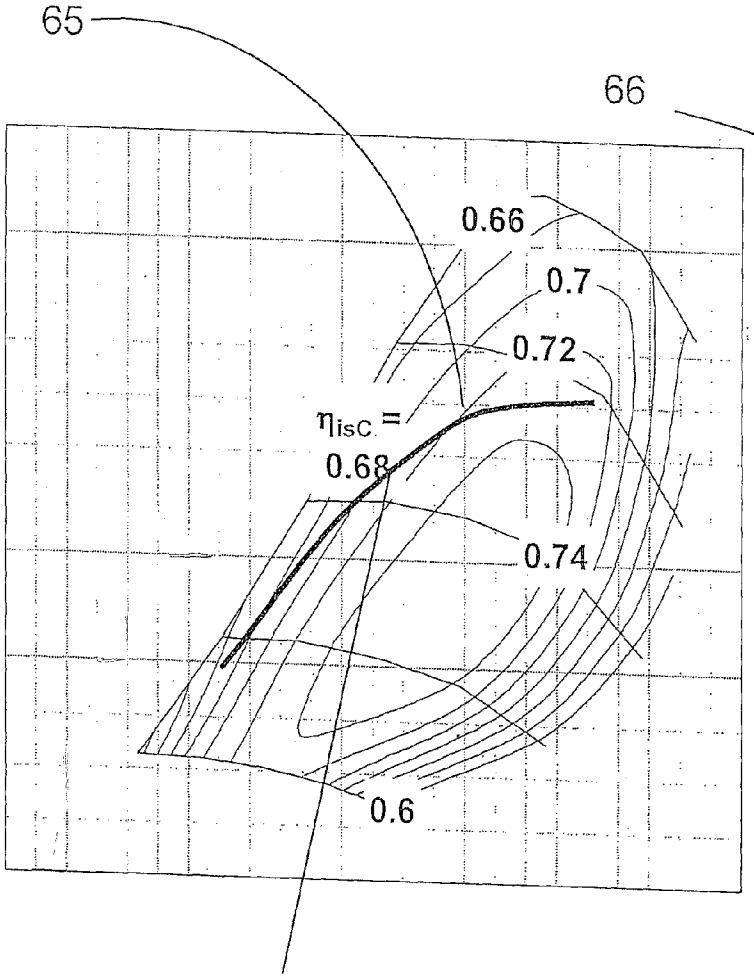
Fig. 6A Prior Art
Figure 7:
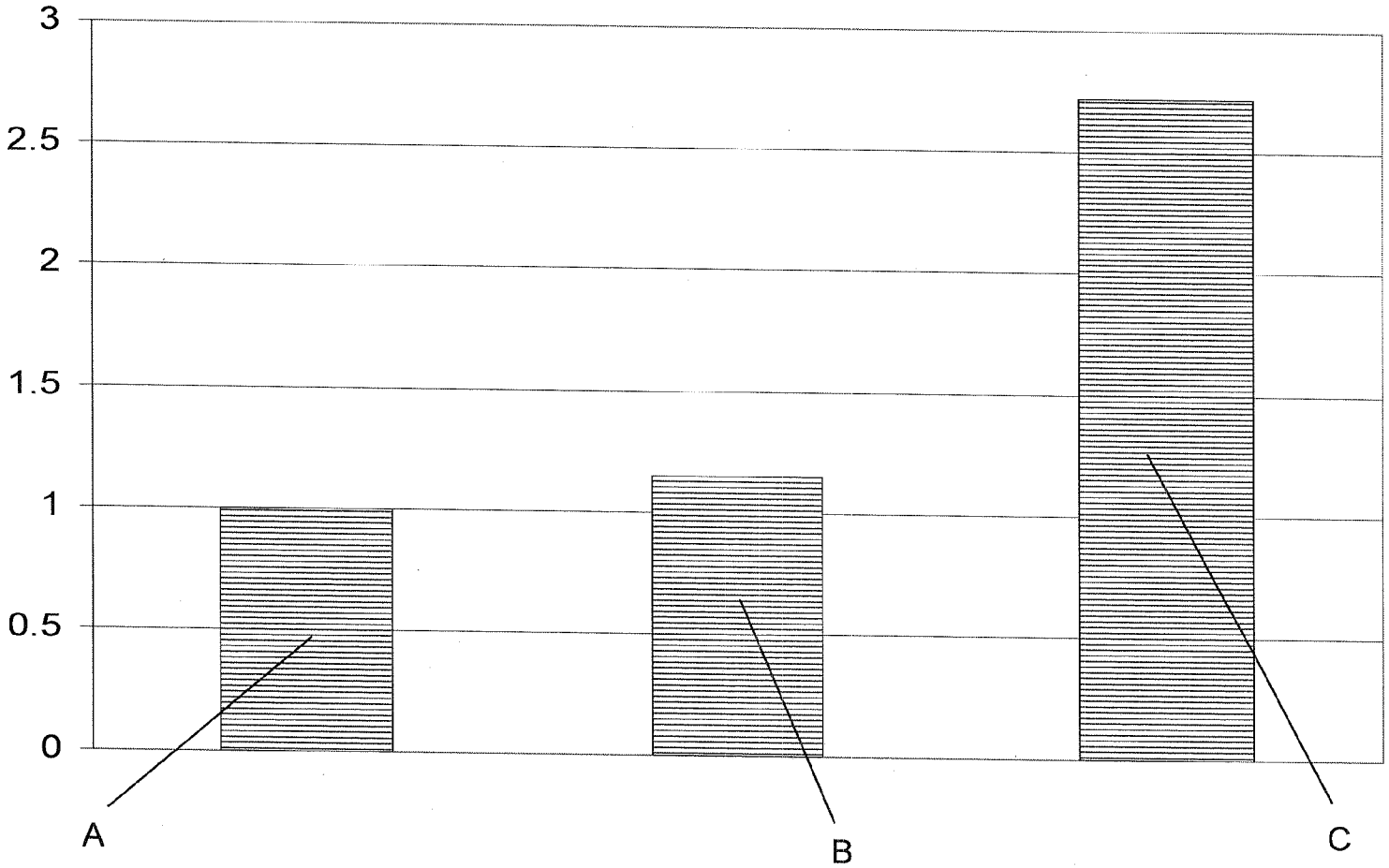
FIG. 7 is a chart showing turbocharger relative costs.
Figure 8B:
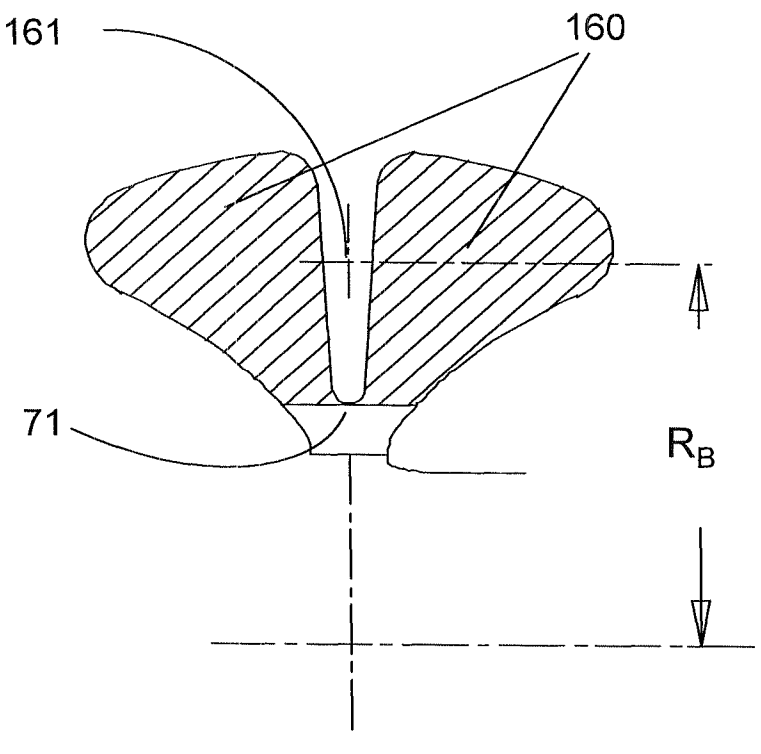
FIG. 8 depicts the sections of some volutes at slice "A"
Figure 8A:
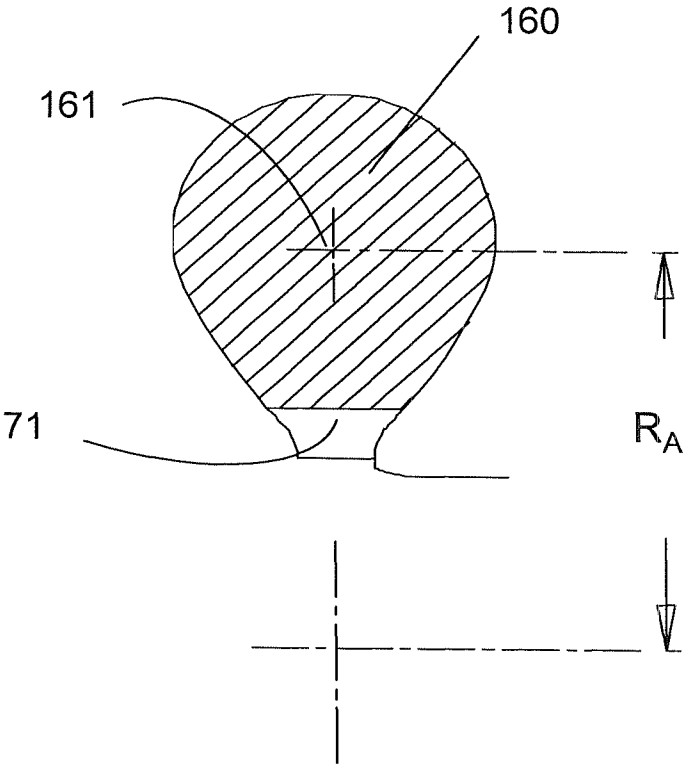
Figure 9A:
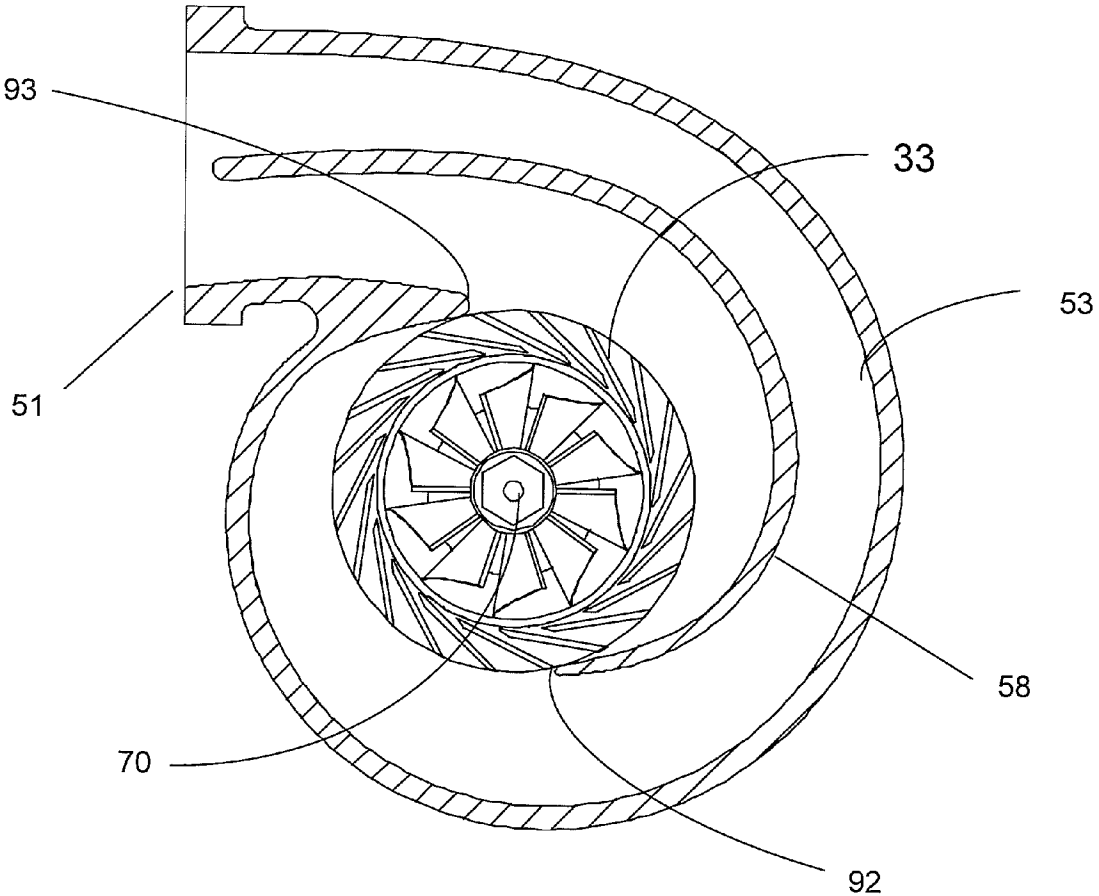
Fig. 9A Prior Art
FIG. 9A depicts a double-flow turbine housing with nozzle ring.
Figure 9B:
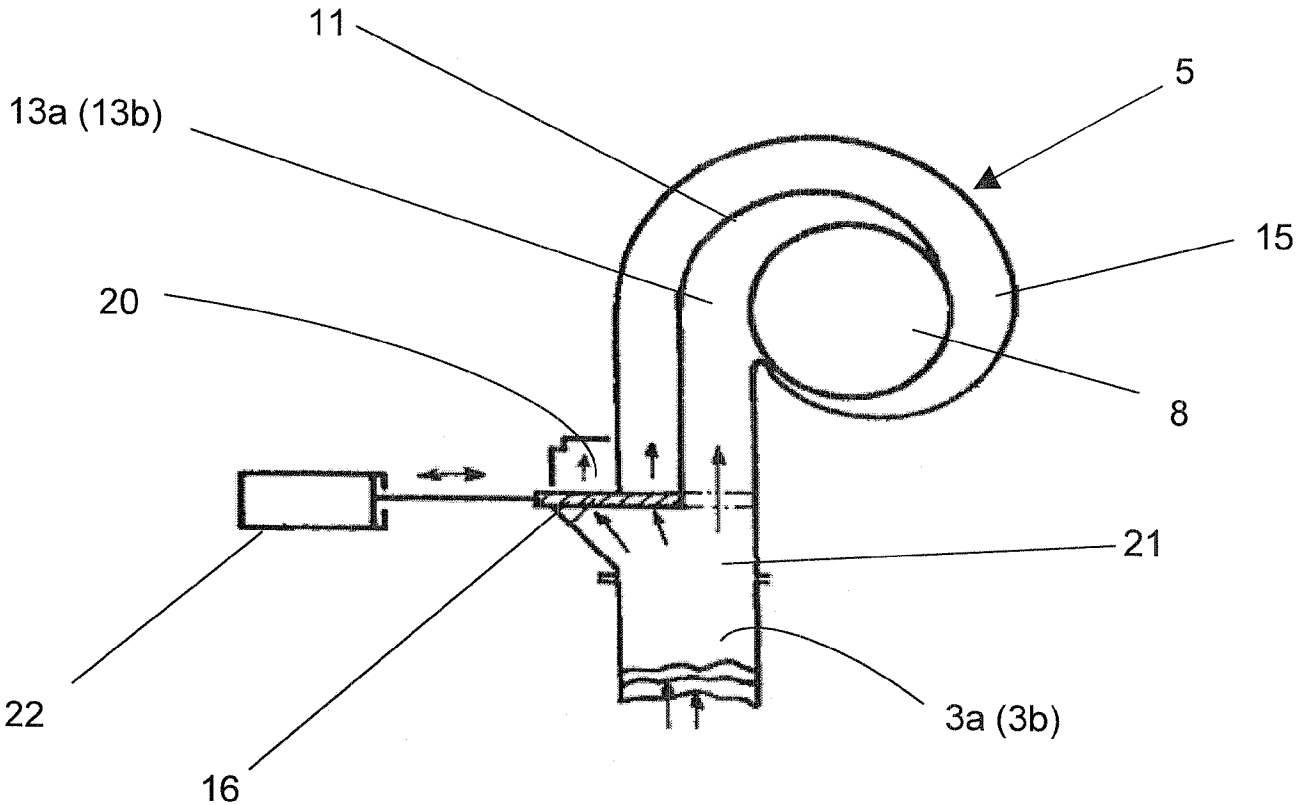
Fig. 9B Prior Art
FIG. 9B depicts the prior art of U.S. Pat. No. 4,389,845

In the case of prior art "double" flow turbine housings, as shown in FIG. 9A, the entry to the turbine housing at the foot (51) is divided into two separate volutes. The outer volute is bound outwardly by the outer wall (53) of what would be the existing volute and on the inside by a volute wall (58) parallel to the turbocharger axis, spanning the existing volute side walls. The inner volute is bound radially outwardly by the inside side of the above wall (58), transversely by the side walls of the existing volute, and the inner boundary of the volute can be envisioned as a perfect circle, defined as the base circle or, in certain cases, it can describe a spiral, of minimum diameter not less than 106% of the turbine wheel diameter. Thus the turbine housing has two tongues, one at the end of each volute outer wall.

The turbine housing component of the first embodiment of the present invention consists of a plurality (greater than two) of volutes configured such that the entry to the multiple volutes is near the foot (51) and the exits of each volute are arranged around the base circle of the turbine housing. The volutes can be co-planar, or the volutes can cross over each other. What is important is that the volutes cumulatively deliver exhaust air to the circumference of the turbine wheel, terminating at a distance greater than or equal to a diameter of 106% of the turbine wheel diameter, in an adjacent configuration.

Figure 12B:
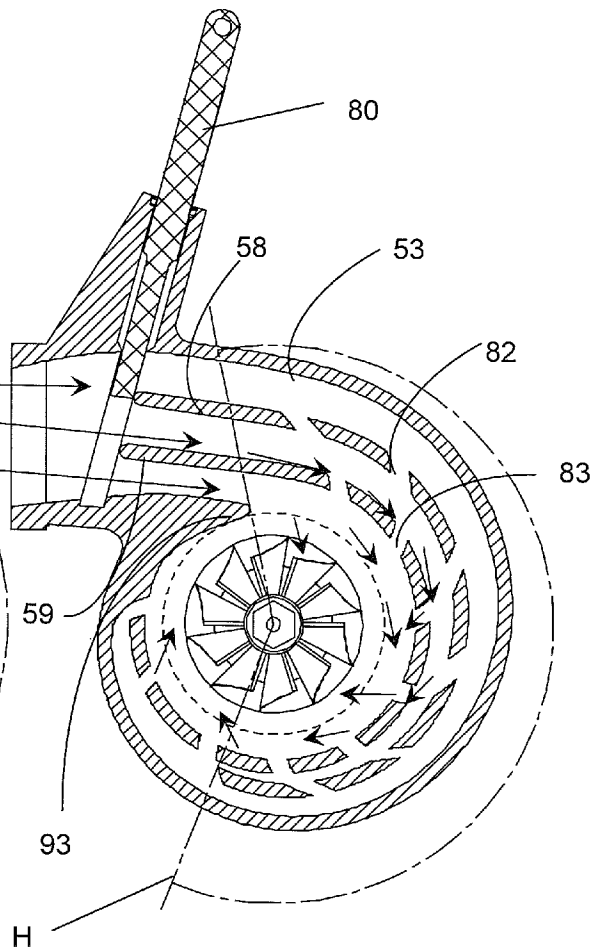
FIGS. 12A and 12B depict two sections of the second embodiment of the invention.
Figure 12A:
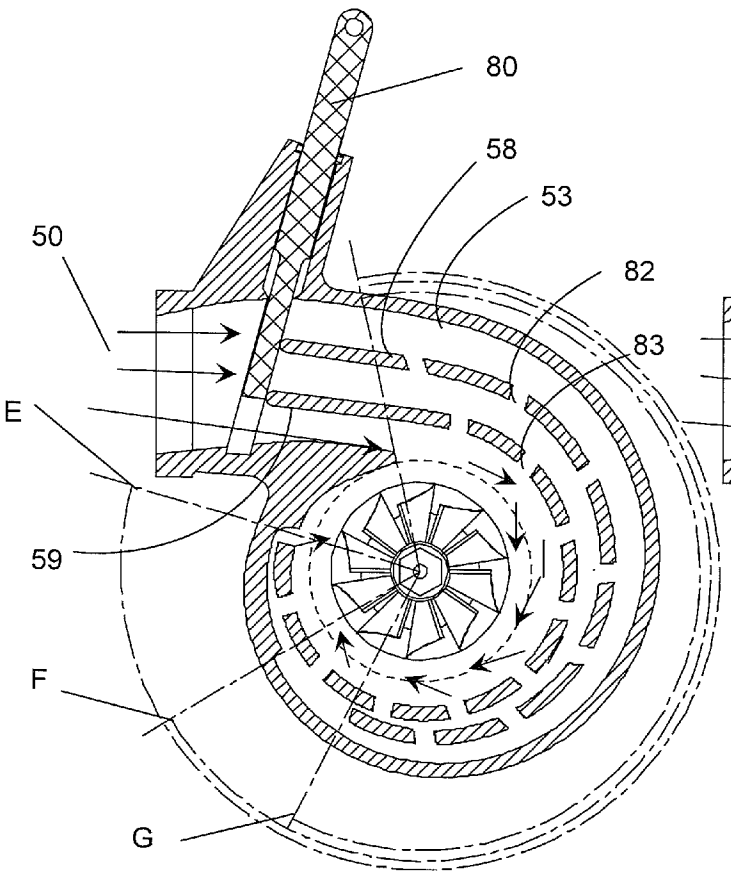

In the exemplary first embodiment of the invention, as seen in FIGS. 12A and 12B, the turbine housing has an outer volute bound outwardly by the inner side of the outer wall (53) of the turbine housing. The inner wall of the outer volute is the outside of the first transverse divider wall (58). The "Z" axis walls are bound by walls close to the side walls which would exist in a typical turbine housing. The center, or second volute (from the outside) is bound by the inner face of the outer transverse wall and the inner bound of the center, or second volute is the outer face of the third transverse divider wall (59). The inner volute is bound inwardly by the theoretical base circle or spiral or vortex at a distance greater than, or equal to, a diameter of 106% the turbine wheel diameter. In the case for more than three volutes the logic for the internal volutes is the same as that described above.

In the first embodiment of the invention, as seen in FIGS. 12A and 12B, the volute is divided into three volute areas—outer, middle, and inner—by two transverse divider walls (58, 59) oriented generally parallel to the turbocharger axis, with the volutes designed to terminate close to the base circle or vortex, near where the volute would have terminated had there been a singular outer wall and no divider walls, near the termination point (93) of the outer wall (53). In FIG. 12A the inner divider wall (59) continues until it intersects the outer wall (53) of the turbine housing at a point "E" from 290° and 310° from section "A", and the outer divider wall (58) continues to the same point, being non-perforated after point "F" between 240° and 265° from section "A". In FIG. 12B the inner divider wall is the same as in FIG. 12A in that it continues until it intersects the outer wall (53) of the turbine housing at point "E" between 290° and 310°, but the outer divider wall (58) terminates at a point "H", between 200° to 225° from section "A".

Figures 13A, 13B:
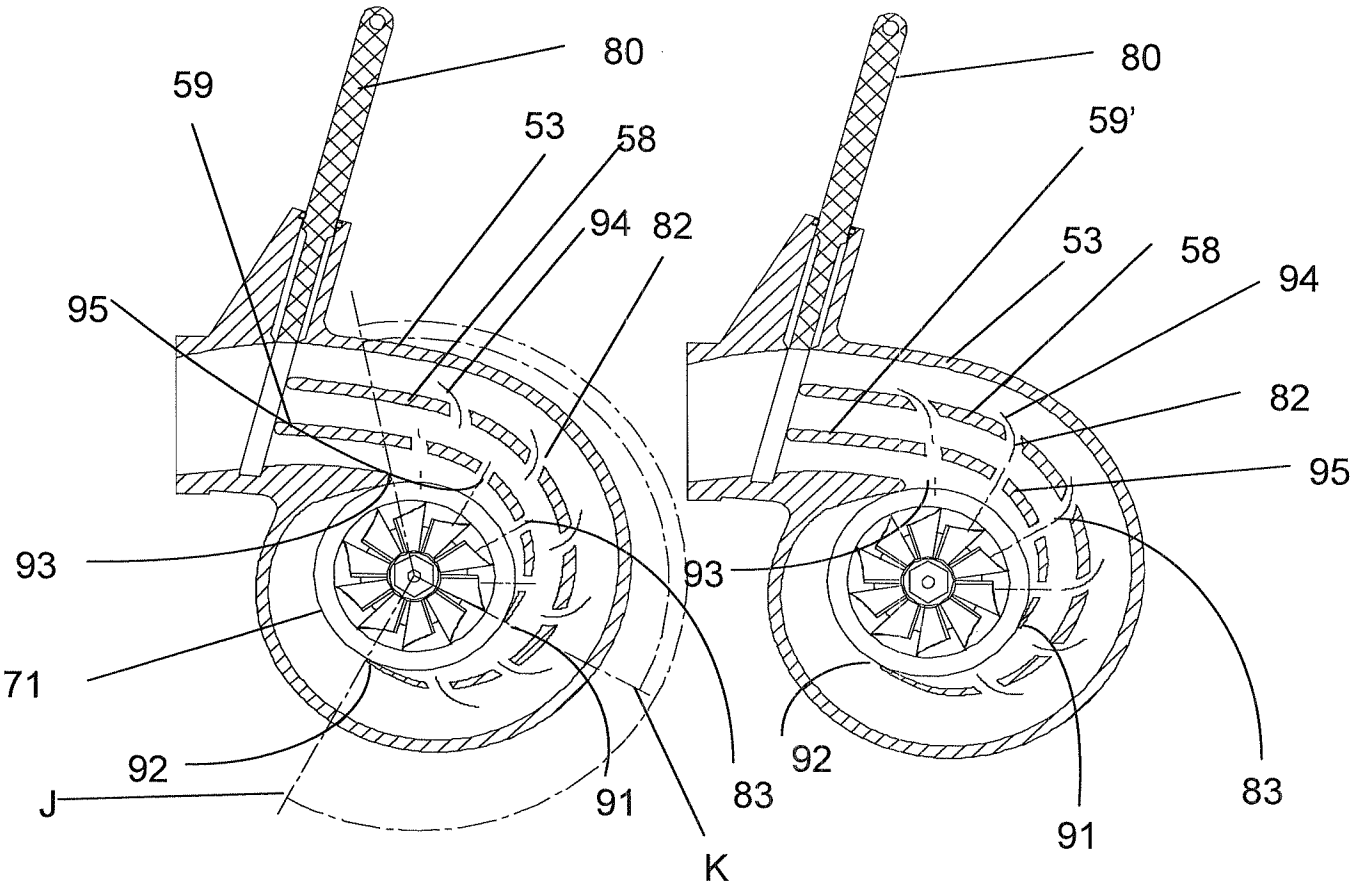
FIGS. 13A and 13B depict two sections of the second embodiment of the invention with two exits to the volute.
Figures 14A, 14B, 14C:
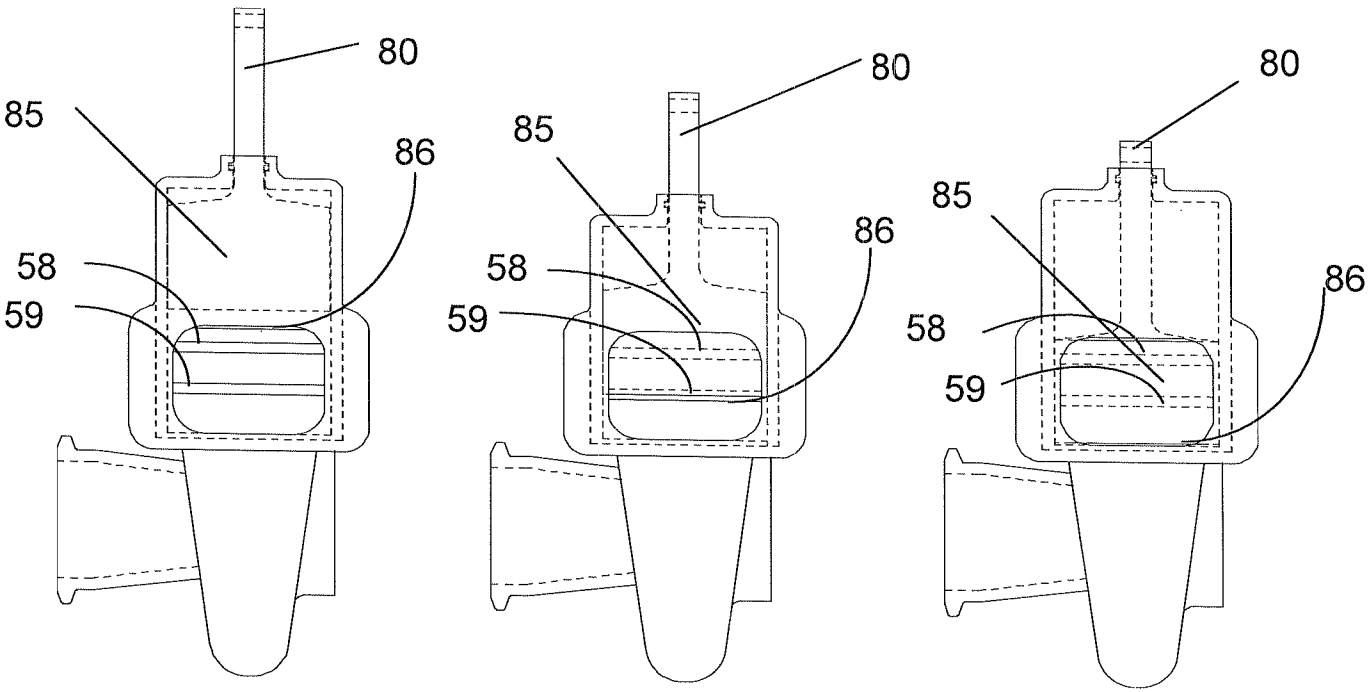
FIGS. 14A, 14B and 14C depict three views of the invention with different blade positions and FIGS. 15A, B depict two views of the third embodiment of the invention.

In the second embodiment of the invention, as shown in FIGS. 13A and 13B, the trailing edges of the multiple perforated transverse divider walls terminate near the base circle or vortex such that the flow segments from each volute, plus the thickness of the divider walls, totals a spread of 360°. The division of a circle formed by the trailing edges, or tongues, of the plurality of transverse divider walls, centered on the turbocharger axis such that the circle is divided, preferably into approximately equal, sections per volute. In the illustrated embodiment, three volutes are illustrated, each delivering exhaust flow to approximately 120° of circumference of the turbine wheel In the second embodiment of the invention, the trailing edge of the inner transverse divider wall (59') terminates at a point "K" on a radial at an angle of from, e.g., 120° to 140° from section "A". The trailing edge of the outer transverse divider wall (58') terminates at a point "J" on a radial at an angle of from, e.g., 210° to 230° from section "A".

In the first and second embodiments of the invention, the flow from the exhaust manifold to the turbocharger volutes is controlled by the blade portion (85) of a sliding gate (80). The gate can be configured adjacent to the turbine housing foot (50), preferably at an angle from −30° to +45° to the turbine housing foot. The sliding blade slides in a passageway within the turbine housing to minimize leakage of exhaust gas from the turbine housing. In the exemplary embodiment of the invention the actuating post of the sliding gate (80) is fabricated to have a circular section (84) to satisfy the requirement of a seal using a typical turbocharger piston ring as the sealing mechanism.

Figure 10A:
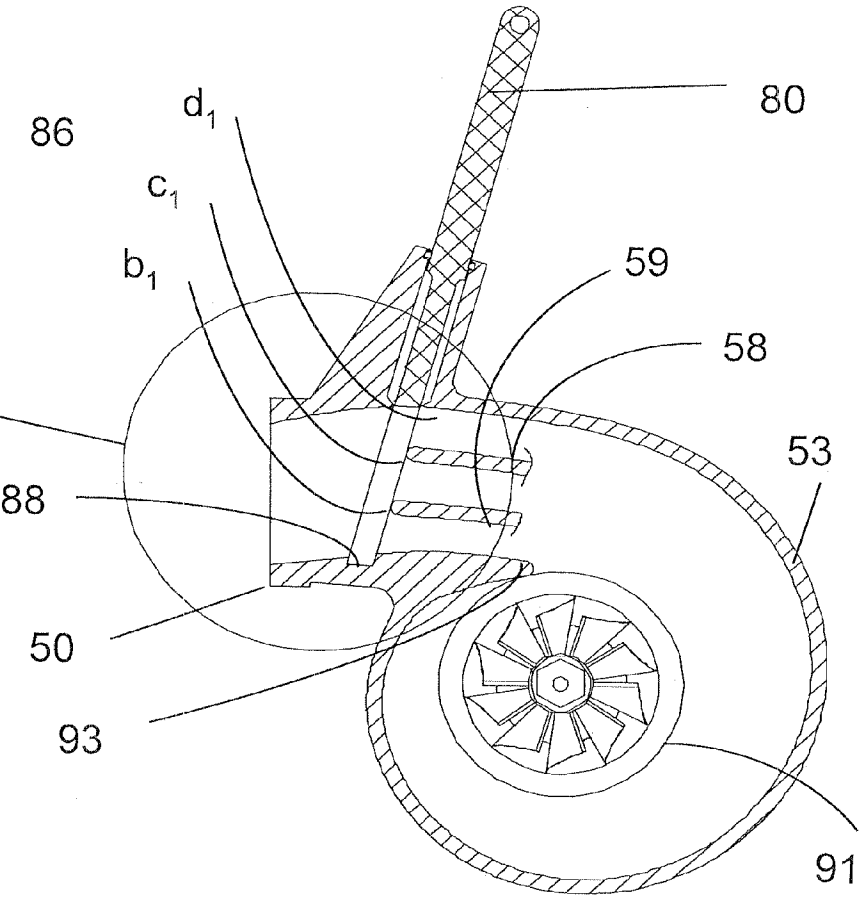
FIG. 10A depicts a section of the first embodiment of the invention, with a magnified zone in FIG. 10B.
Figure 10B:
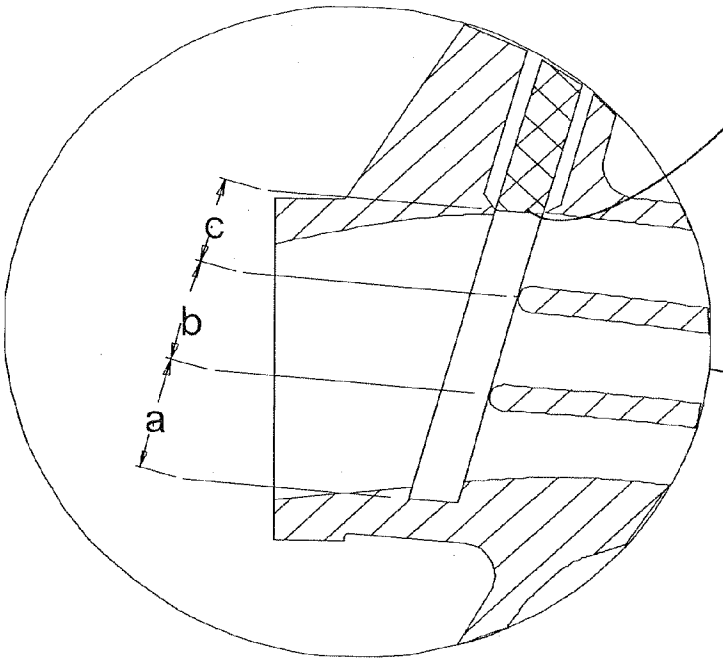

Since one of the essential drivers in this invention is cost reduction, the selection of a sliding blade type of controlling device allows for the use of a simple actuator which provides for movement from one distinct position to the next distinct position. No modulation from the actuator is required. A "three position" actuator is simpler, and thus less expensive and easier to control, than an infinitely controllable actuator, thus further contributing to the goal of cost reduction. In FIG. 10A, the distance from the fully closed position of the blade to the position in which the leading edge (86) of the blade is adjacent to the tip of the leading edge (b.sub.1) of the inner divider wall (59) is distance "a". The distance from the center of the leading edge (b.sub.1) of the inner divider wall (59) to the center of the leading edge (c.sub.1) of the next divider wall (58) is distance "b". Similarly the distance from the center of the leading edge (c.sub.1) of the divider wall (58) to the center of the leading edge (d.sub.1) of the next divider wall, or the outer wall in the case of the exemplary embodiment of the invention as seen in FIG. 10B, is distance "c". The relationship between "a", "b" and "c" is such that the steps can be equal to each other or not equal to each other, but the sum of distinct step positions should equal the flow area through the volute.

Figure 11B:
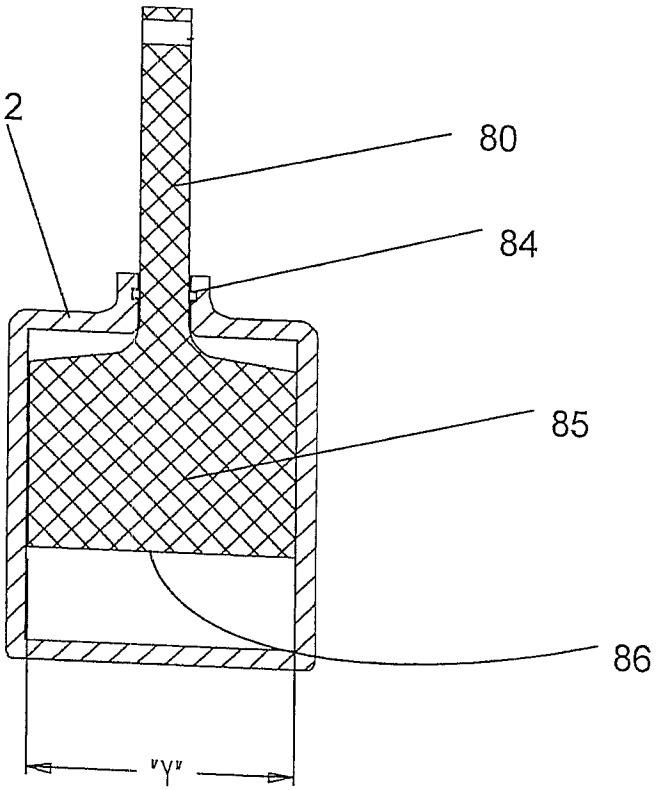
FIGS. 11A and 11B depict a pair of section showing details of blade options.
Figure 11A:
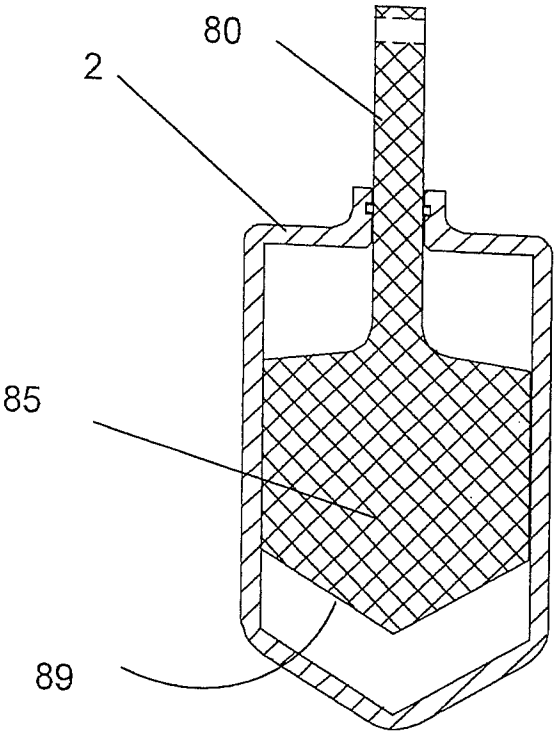

If more modulation than can be provided by a move from one distinct position to the next distinct position, as explained above, is required, the blade (85) can have an alternate geometry such as a 45° angle as seen in FIG. 11A, or some other geometry which provides less than a 1:1 ratio of move to opening area. With the invention as described, when the blade portion (85) moves a displacement of "a, b, or c" the area uncovered is "a, b, or c" times the width "Y". With a geometry describing the leading edge (89) of the blade (85) as greater than dimension "Y" the area uncovered by a distinct move of the blade, through a displacement of "a, b, or c" will be less than that uncovered by a distinct move of the blade with a dimension "Y" equal to the perpendicular distance between the ends of the sides of the blade. This distinction may require a set of intermediate steps but they will be discreet steps, not modulated moves to a new position.

The blade (85) is thus designed to be able to close one, two or even three of the three exemplified volute portions. Closing or nearly closing all three volute portions is desirable for certain operations such as engine braking, turbocharger bypass at engine light-off, increasing exhaust back pressure for rapid engine warm-up.

In both the first and second embodiments of the invention the transverse divider walls are perforated, slotted or split at multiple locations to allow the outer volutes to feed the inner volutes and the turbine wheel as the sliding gate admits more exhaust gas into the volute. These multiple slots (82, 83) can be arranged in any fashion, as long as their function is to allow exhaust gas from an adjacent outer volute to flow to the next adjacent inner volute, or in the case of the adjacent inner volute being the most inner volute, the exhaust gas feeds to the turbine wheel. The slots may be linear, they may be curved, they may be tangential rather than perpendicular to the dividing walls, and they may be co-planar or may form nozzles. The function and design of the slots in the slotted transverse divider walls is preferably the same as the function of the vanes on a fixed nozzle ring in that, as seen in FIG. 9A, the vanes assist in the turning and acceleration of the exhaust gas into the turbine wheel.

The detail of the slots is the same for the first embodiment and the second embodiment of the invention. For illustrative purposes, in FIG. 13A, the slots line up on the calculated flow paths, in FIG. 13B the flow paths (94 and 95) are offset to provide more mixing of the flow. The upstream and downstream edges of the slots are offset from the predicted flow paths.

Figure 15B:
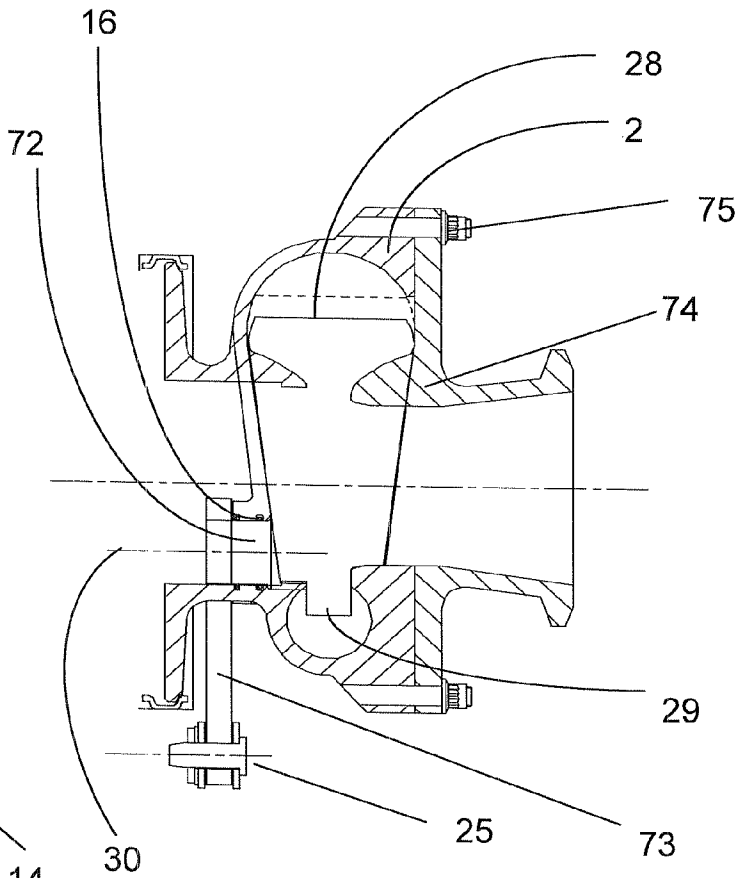
Figure 15A:
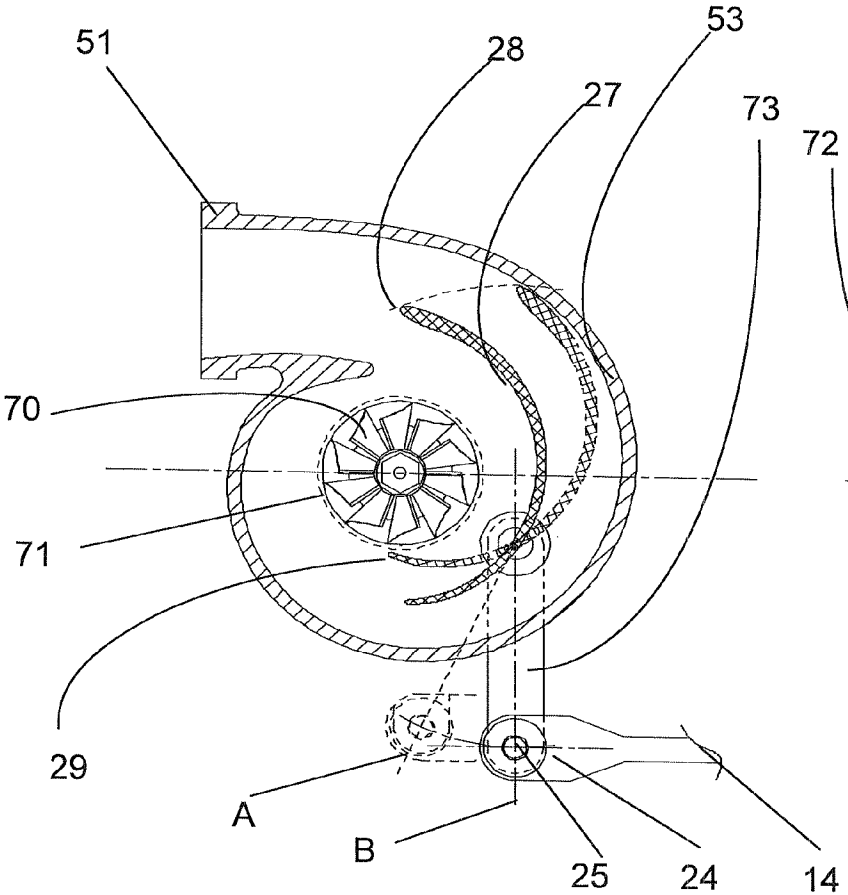

In the third embodiment of the invention, as depicted in FIGS. 15A and 15B, the flow of exhaust gas to the turbine wheel (70) is controlled by the rotation of a pivoting transverse divider wall (27) which is driven by an actuator driving an actuator rod (14) through a clevis (24). A clevis pin (25) transmits the actuator drive though an actuation arm (73), which in turn rotates and actuator shaft (72) about an axis (30).

The pivoting transverse divider wall (27) has a leading edge (28) and a trailing edge (29) and rotates about the axis (30) of the actuator shaft (72). For the sake of clarity the extreme positions of the actuation arm (73) are marked as "A" and "B". In position "B" the pivoting transverse divider wall (27) has its leading edge (28) close to the center of the volute cross-sectional area, thus effectively directly the incoming flow of exhaust gas both under and over the transverse divider wall. This splitting of the exhaust flow forces the gas on the outside of the transverse divider wall to flow to the turbine wheel only downstream of the trailing edge (29) of the pivoting transverse divider wall (27). In this position the trailing edge (29) of the pivoting transverse divider wall (27) is also close to the center of the volute.

For ease of assembly, the turbine housing is split into two parts, the turbine housing (2) and the closure (74) to the turbine housing. The closure (74), in the exemplary third variation of the invention, is retained by nuts (75) threaded onto studs in tapped holes in the turbine housing (2); but it could be retained by bolts; bolts and nuts; by peening; by staking; or by welding.

In position "A" the pivoting transverse divider wall (27) has its leading edge (28) close to the outer wall (53) of the volute. In this position the trailing edge (29) of the pivoting transverse divider wall (27) is close to the base circle (71) of the turbine wheel (70), which is as close as a stator is permitted to the turbine wheel. This position "A" of the pivoting transverse divider wall (27) effectively closes off a lot of the volute to simulate a smaller volute than that of position "B".

With the pivoting transverse divider wall in position "A" the turbocharger will direct all of the incoming exhaust mass flow to the turbine wheel which will have the effect of speeding up the turbine wheel rotation to provide good transient response characteristics to the engine, albeit at the expense of not being capable of providing sufficient mass flow for maximum boost (from the compressor). In this position the exhaust flow which does not get to the turbine wheel contributes to increasing the exhaust backpressure.

With the pivoting transverse divider wall (27) in position "B", maximum mass flow of exhaust gas will go through the turbine wheel, which allows the turbocharger to achieve the desired maximum boost level, with less transient response performance and with less backpressure.

Thus in the third embodiment of the invention a more simple, lower cost device can perform some of the function normally achieved by a VTG.

Now that the invention has been described, We claim:

1. A variable geometry turbocharger turbine housing comprising:

an exhaust gas inlet (51);

a volute for channeling exhaust gas from said exhaust gas inlet and defined in part by a radially outer volute wall;

a turbine wheel chamber adapted for enveloping a turbine wheel (70) mounted for rotation about an axis;

a vortex zone in which exhaust gas transitions from the volute to the turbine wheel;

an exhaust gas outlet (52);

at least first and second divider walls (58, 59; 58', 59'), generally parallel to the axis of the turbine wheel, dividing the volute into at least first, second and third volute portions, said first and second divider walls each having a plurality of communicating openings (82, 83), said first and second divider walls each having an upstream end and a downstream end; and a sliding gate valve (80), adapted to being moved between positions, wherein in at least one of the positions the sliding gate valve blocks exhaust gas flow to at least one of the volute portions, wherein each volute portion channels exhaust gas to a different circumferential area of the vortex zone.

2. The turbocharger turbine housing as in claim 1, wherein the first and second divider walls divide said volute into at least one radially outer volute portion, one radially inner volute portion, and one volute portion intermediate said outer and inner portions.

3. The turbocharger turbine housing as in claim 1, wherein the first divider wall, measured from a termination point of the radially outer volute wall to a trailing end of the first divider wall (92), spans an arc of from 90° to 150°, and wherein said second divider wall, measured from the trailing end of the first divider wall (92) to the trailing end of the second divider wall, spans an arc of 90° to 150°.

4. The turbocharger turbine housing as in claim 1, wherein each volute portion channels exhaust gas to approximately one-third of the vortex zone.

5. The turbocharger turbine housing as in claim 1, wherein each divider wall measured from a termination point (93) of the radially outer volute wall (53) to a trailing end of the divider wall spans an arc of greater than 180°.

6. The turbocharger turbine housing as in claim 5, wherein each volute portion measured from the termination point (93) of the radially outer volute wall (53) to the trailing end of the volute portion spans an arc of 270° or more.

7. The turbocharger turbine housing as in claim 1, wherein said sliding gate valve is a plate-type gate mounted for reciprocation in a guideway between positions wherein said gate opens all said volute portions, and wherein said gate closes one or more of said volute portions, and wherein said sliding gate has a leading edge cooperating with the leading edge of the first divider wall for completely blocking one volute portion while leaving free another volute portion.

8. The turbocharger turbine housing as in claim 1, wherein said sliding gate valve is a plate-type gate mounted for reciprocation in a guideway between positions in increments smaller than a distance from one divider wall (59, 59') to a next divider wall, whereby movement of said sliding gate produces gradual blockage of said volute portions.

9. The turbocharger turbine housing as in claim 1, wherein said sliding gate valve is a variably positionable gate valve controlled by an intelligent actuator.

* * * * *